United States Patent [19]

Meier

[11] 4,066,294

[45] Jan. 3, 1978

[54] ADJUSTABLE CARRIER APPARATUS TO DEFINE FURNITURE OR THE LIKE

[75] Inventor: Heinz Meier, Palisades, Calif.

[73] Assignee: Landes Manufacturing Company, Los Angeles, Calif.

[21] Appl. No.: 740,395

[22] Filed: Nov. 10, 1976

Related U.S. Application Data

[63] Continuation-in-part of Ser. No. 694,179, June 9, 1976.

[51] Int. Cl.[2] ..... A47C 3/00

[52] U.S. Cl. ..... 297/325

[58] Field of Search ..... 297/130, 118, 325–329, 297/313, 457, 440

[56] References Cited

U.S. PATENT DOCUMENTS 2,740,465 4/1956 Mugler ..... 297/325 X

*Primary Examiner*—Francis K. Zugel

*Attorney, Agent, or Firm*—William W. Haefliger

[57] ABSTRACT

An adjustable carrier comprises:

a. a carrier frame, and b. a rotary support including two integrally interconnected rotors adjustably supporting the frame in a first frame position relative to the support, c. the frame including a stabilizing portion projecting in spaced relation from the rotary support in each of said positions.

The frame and rotary support may, for example, define a chaise lounge or a chair.

2 Claims, 12 Drawing Figures

ADJUSTABLE CARRIER APPARATUS TO DEFINE FURNITURE OR THE LIKE

BACKGROUND OF THE INVENTION

This application is a continuation-in-part of my copending application Ser. No. 694,179 filed June 9, 1976.

This invention relates generally to adjustable carrier apparatus, and more particularly concerns apparatus defining a very simple adjustable combination of a carrier frame and rotary support. Such apparatus is especially adapted to incorporation in furniture design, as for example chairs and chaise lounges. While the invention will be described in relation to the latter, it will be understood as having wide applications.

There is a continuing need for furniture such as chairs characterized by low-cost, lightweight, simple construction. There is also a need for chairs which have different seating elevations and different backrest recline elevations. Insofar as I am aware, there is no previous chair combining most or all of these features, in the unusually advantageous manner as is now provided by the invention. As will be seen, the chair requires no hinges, yet achieves different seating elevations and backrest recline angles, in a simple, two-piece design.

SUMMARY OF THE INVENTION

It is a major object of the invention to provide adjustable carriage apparatus, as for example a chair or chaise lounge, embodying advantages and features mentioned above, as well as others that will appear. Basically, the apparatus comprises:

a. a carrier frame, and b. a rotary support including two integrally interconnected rotors adjustably supporting the frame in a first frame position relative to the support, c. the frame including a stabilizing portion projecting in spaced relation from the rotary support in each of said positions.

Further, the frame may have an alternate or second position relative to the rotary support, the two frame positions typically being at different elevations; such two elevations may be characterized by different seat elevations and backrest inclinations in the base of a chaise longue; the rotors or wheels may be integrally interconnected by cross tie members (as for example three such members) providing shoulders to removably support the frame; hook means may be provided on the frame to selectively engage the cross tie members in different configurations, to block rotor rotation; and hinge means may interconnect the rotors and frame, as will be described.

These and other objects and advantages of the invention, as well as the details of an illustrative embodiment, will be more fully understood from the following description and drawings, in which:

DRAWING DESCRIPTION

DETAILED DESCRIPTION

Figure 1:
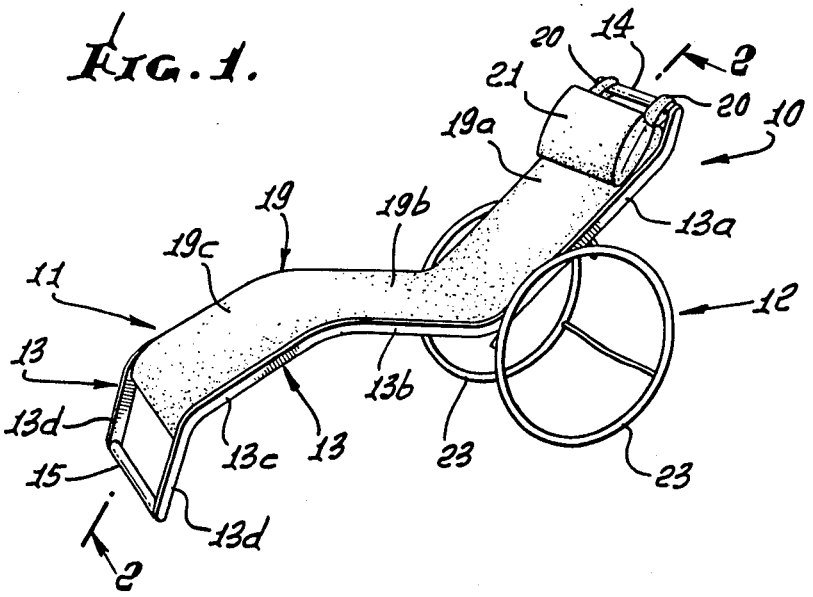
FIG. 1 is a perspective showing of a chaise lounge embodying the invention.
Figure 2:
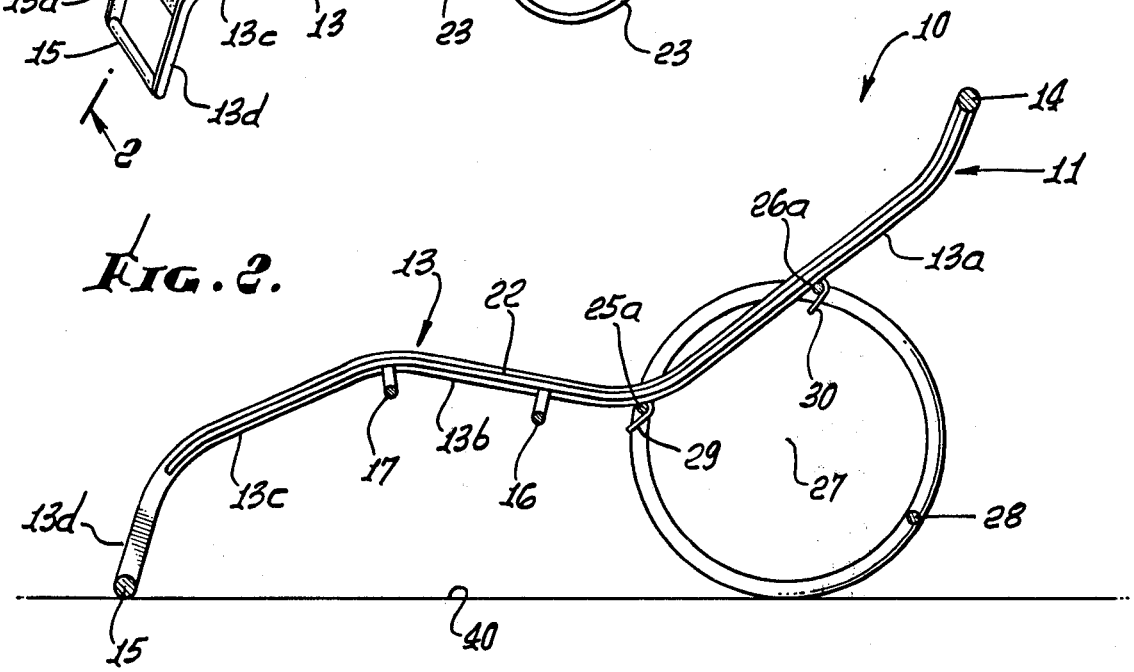
FIG. 2 is a side elevation, taken in section, of the chaise lounge of FIG. 1.
Figure 3:
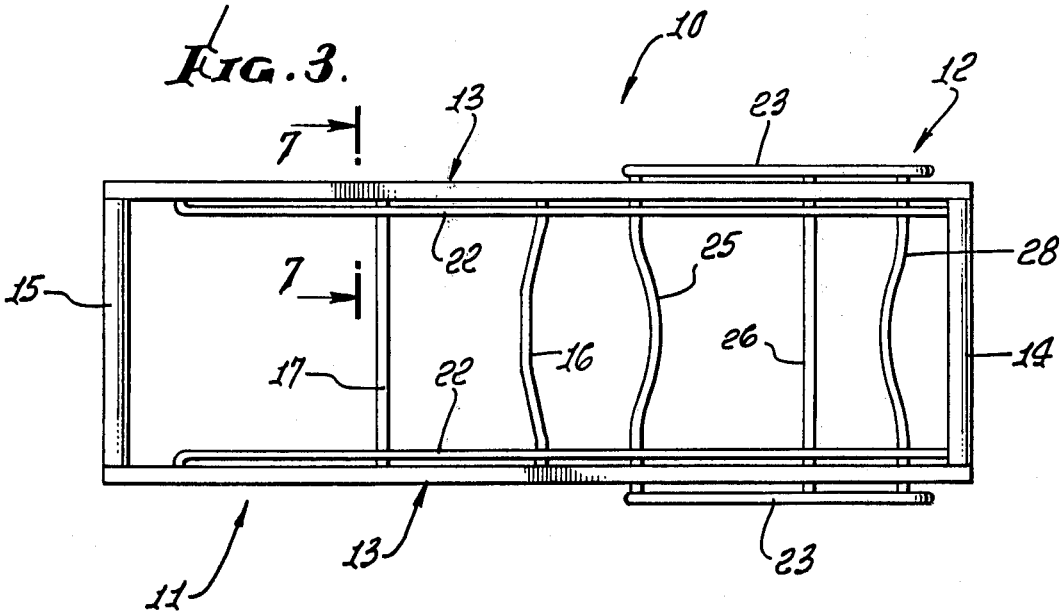
FIG. 3 is a top plane view of FIG. 2; without certain sling structure.

In FIGS. 1–3, an adjustable carrier 10 has the form of furniture such as a chaise lounge. The carrier includes a frame 11 and a rotary support 12 removably supporting the frame in a first stable frame position relative to the support 12.

The frame 11 may be endwise elongated and include two like side members 13 each having sections **13*a*—13*d*, and cross members 14–17. The cross members may comprise light weight metallic tubes, member 14 interconnecting side sections 13*a* and member 15 interconnecting side sections 13*d*. Also member 16 interconnects side sections 13*b* and member 17 interconnects side sections 13*c*** at a knee location. The side members and sections may consist of metallic bars, curved and angled as shown.

Figure 7:
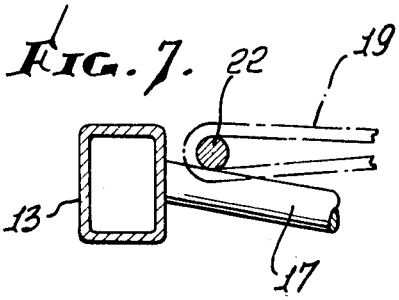
FIG. 7 is a section on lines 7—7 of FIG. 3.

A flexible fabric sling 19 is carried by the frame to extend between the side members 13 and to follow the contour of sections **13*a*—13*e*. Thus, the sling provides a backrest at 19*a*, a seat at 19*b* and a leg rest at 19*c*. A back rest portion of the frame may include the members 13*a*. The sling, at its sides, is wrapped around the side rails 22 which follow the cotours of the members 13, at the inner sides thereof. End straps 20 may loop over cross-member 14 to support a head rest 21. FIG. 7 shows side rail 22 supporting the sling and supported by cross-member 17 and side member 13**. Other methods of supporting the sling on the frame may be employed.

The rotary support 12 may include two laterally spaced and interconnected rotors such as wheels 23 which extend upright. The rotors have laterally projecting shoulders to removably support the frame in each frame position, as for example the relatively raised position of the frame in FIG. 2, and the relatively lowered position of the frame in FIG. 4. Such shoulders may include first shoulders **25*a* defined by a first tie member 25 interconnecting the rotors, and second shoulders 26*a* defined by a second tie member 26 interconnecting the rotors. The curved tie members 25 and 26 extend laterally between the rotors and at angularly spaced locations about a common axis 27 of rotation defined by the two rotors. A third tie member 28 also extends between the rotors or wheels, at a third location angularly spaced about axis 27 from members 25 and 26**. Accordingly, the rotors or wheels are relatively rigidly interconnected at three tie locations, to maintain them in parallel upright condition; at the same time, the rotors and tie members define a lightweight metallic support which can be easily rolled about for storage or for shifting its position in a room.

The frame carries interengagement or hook means located to selectively engage the tie members, as for example the first and second shoulders **25*a* and 26*a*. For example, the hook means may include primary laterally spaced hooks 29, and secondary laterally spaced hooks 30, the latter longitudinally spaced from the former, along the frame and depending from the frame side members 13. FIG. 2 shows hooks 29 selectively engaging shoulders 25***a*, and hooks 30 selectively engaging shoulders 26*a*, the frame there being supported in relatively high position. Contrast with this the relatively lower frame position in FIG. 4, with hooks 30 selectively engaging shoulders 25*a* on tie member 25, and hooks 29 free of engagement with any shoulders.

Figure 4:
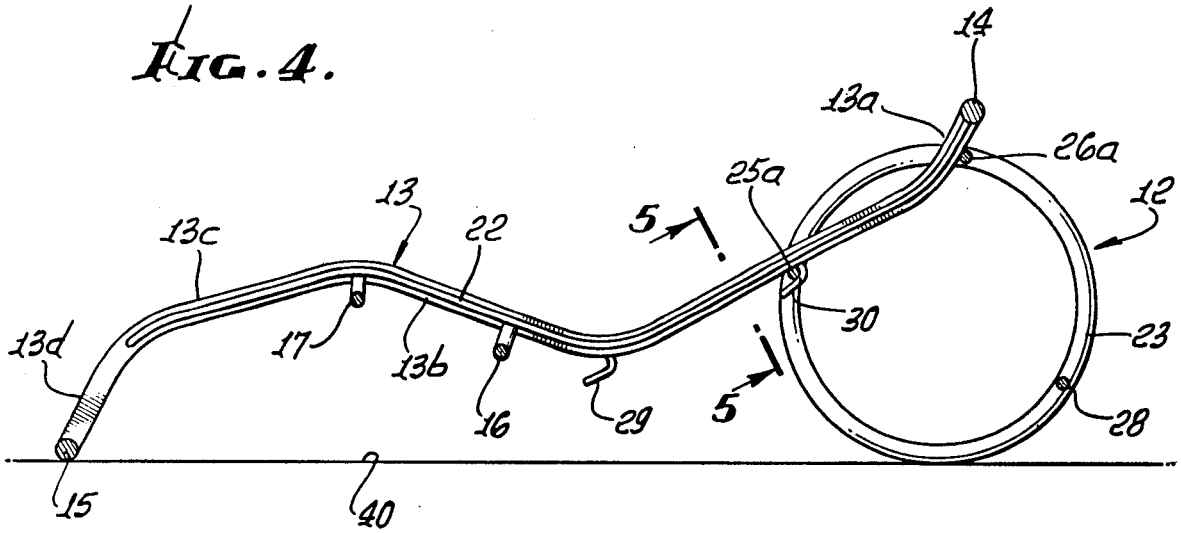
FIG. 4 is a side elevation, taken in section, of the chaise longue in another position.
Figure 5:
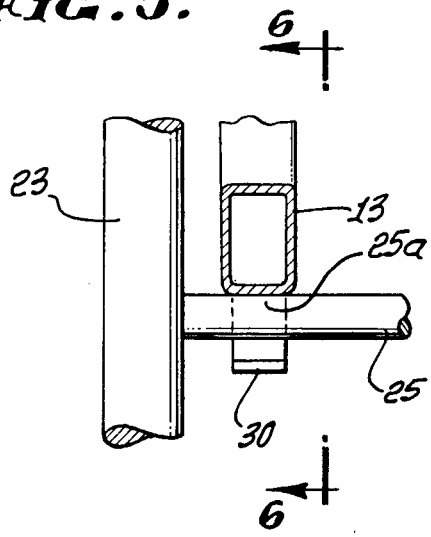
FIG. 5 is a section on lines 5—5 of FIG. 4.
Figure 6:
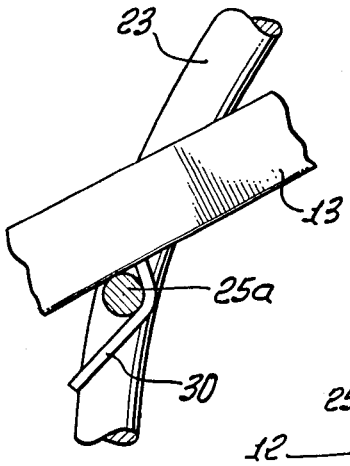
FIG. 6 is a side elevation, in section, on lines 6—6 of FIG. 5.
Figure 9:
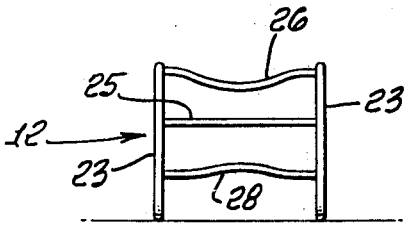
FIG. 9 is an end elevation showing two supports and a tie member.

The rotors are prevented from rotating in FIG. 2 by virtue of the fact that both hooks 29 and 30 engage the respective shoulders 25*a* and 26*a*; and the rotors are prevented from rotating counterclockwise in FIG. 4 by virtue of the fact that hooks 30 engage shoulders 25*a* and the shoulders 26*a* engage and are blocked by the frame side member sections 13*a*, as shown. If desired, the rotors may be rotated to cause the tie members 26 to interfit hooks 30, and the tie member 28 to engage the frame side member sections 13*a*, to achieve a still lower frame position. Note in this regard that the spacing of tie member 28 from tie member 26 is greater than the spacing of tie member 26 from tie member 25.

A stabilizing portion of the frame, as for example leg sections 13*d*, projects in remotely spaced relation from the rotors support 12, in each position of the frame, to engage the floor 40, as shown. The back rest portion of the frame is shown as substantially entirely supported on the rotors in each of the FIG. 2 and FIG. 4 positions of the frame, for example.

Figure 8:
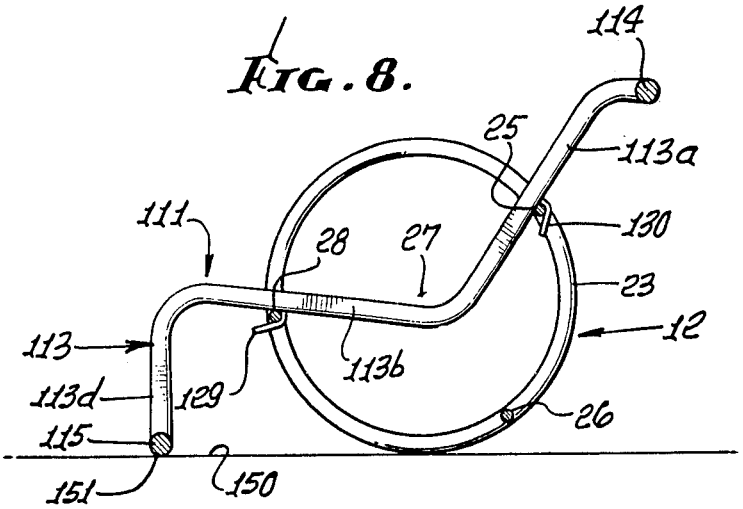
FIG. 8 is a side elevation, taken in section, of a chair embodying the invention.

In FIG. 8, the rotary support 12 is similar to that in FIGS. 1–7, with two wheels 23 and cross tie members 25, 26 and 28. The frame 111 is modified somewhat, i.e. reduced in length to form a chair. The frame includes side members 113 as before, each including back sections 113*a*, seat section 113*b* and end support "leg" 113*d*. Depending hooks 129 and 130 on each frame side member 13 engage the cross tie members 28 and 25, to support the frame on the wheels. The frame leg 113*d* provides the stabilizing portion that projects in spaced relation to the rotary support 12, and engages the ground 150 at 151. Note the provision of frame cross-members at 114 and 115, member 115 integral with leg sections 113*d*.

Rotors 12 may consist of other materials, such as wood or heavy metal.

Figure 10:
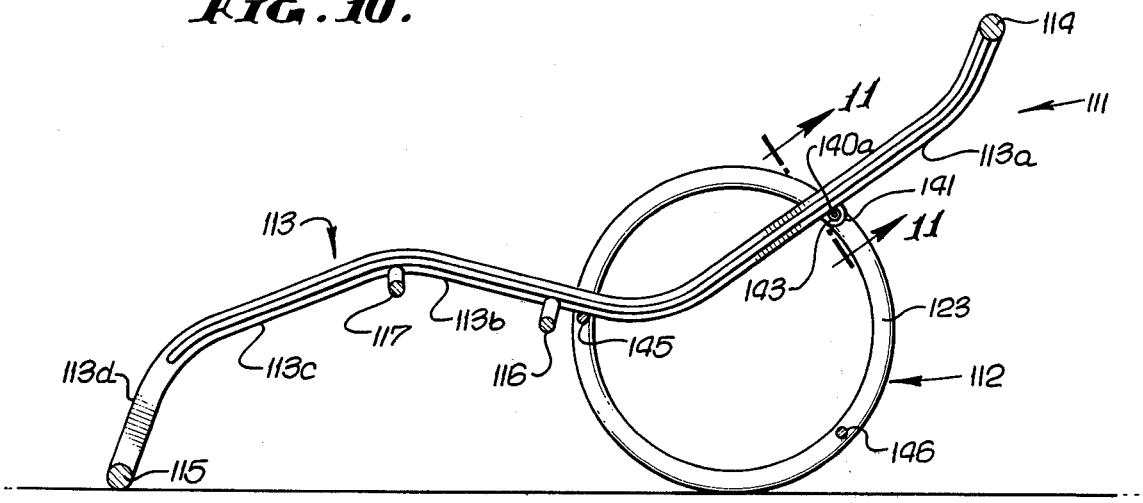
FIG. 10 is a view like FIG. 2, showing a modification.
Figure 11:
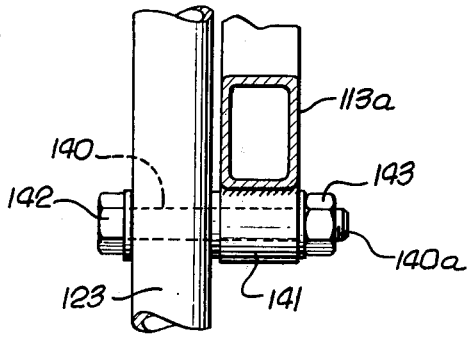
FIG. 11 is an enlarged section taken on lines 11—11 of FIG. 10.
Figure 12:
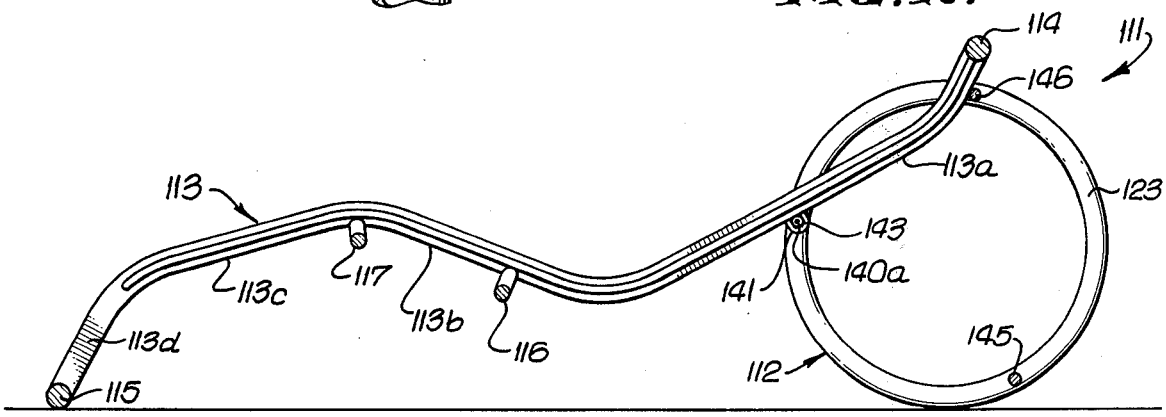
FIG. 12 is a view like FIG. 4, and showing the modification.

Referring now to FIGS. 10–12, the modified frame 111 corresponds to frame 11, previously described, and elements 113, 113*a*, 113*b*, 113*c*, 113*d*, 114, 115, 116, 117, correspond to elements 13, 13*a*, 13*b*, 13*c*, 13*d*, 14, 15, 16 and 17.

The rotary support 112 includes two laterally spaced and interconnected rotors such as wheels 123, corresponding to wheels 23. The wheels extend in parallel, spaced apart, upright positions, and have laterally projecting shoulders for selectively supporting the frame in different positions in which the rotors are relatively rotated, FIGS. 10 and 12 showing two such alternate positions. Note that the frame in FIG. 12 is lower than in FIG. 10. In this modification, the frame and rotary support have hinged interconnection whereby the frame can be elevated slightly and pulled horizontally to a different location, and the rotary support 112 will also be pulled to that location; thereafter, the rotary support can be rotatably adjusted to support the frame at desired elevation, as in FIGS. 10 and 12, for example.

The hinged interconnection in FIGS. 10–12 includes shaft elements 140 and bearing elements 141 receiving the shafts. Thus, the shafts in the forms of pins are integral with the rotors, and project laterally into the bearings integral with the frame side section 113*a*. The pins may be in the form of fasteners including heads 142 and nuts 143 tightened on the threaded ends 140*a* of the pins or shafts. The shaft and bearing elements typically define certain shoulders for selectively supporting the frame in different positions, as described.

Other shoulders on the rotors or wheels support the frame at locations spaced from the shaft and bearing elements. Thus, such other shoulders may include cross tie member 145 interconnecting the two wheels, and supporting the undersides of the frame sections 113*b*, in FIG. 10. Also, after rotation of the wheels to position seen in FIG. 12, the other shoulders are provided by cross-tie member 146 supporting the undersides of the frame side sections 113*a*. Member 146 also integrally interconnects the rotors or wheels. Accordingly, the structure is very simple since members 145 and 146 each serve dual functions. The back rest portion of the frame is shown as substantially entirely supported on the rotors in each of the FIGS. 10 and 11 positions of the frame.

I claim:

1. In adjustable carrier apparatus a. a carrier frame, and b. a rotary support including two integrally interconnected upright wheels supporting the frame in a first frame position relative to the support, the frame having a second and alternate position relative to the rotary support, in which the rotary support supports the frame c. the frame including a stabilizing portion having a seat and a ground engaging portion projecting in forwardly spaced relation from the rotary support in each of said positions, and d. the frame having a backrest portion which is substantially entirely supported on the rotary support in each of said first and second positions, the support of the frame by the rotary support blocking rotation of the support in each of the two frame positions, e. the rotary support including multiple tie members connected only to peripheral portions of the wheels and extending laterally therebetween, the wheels being centrally open, said members angularly and sequentially spaced about a common axis of rotation defined by said wheels, f. the frame and said rotary support having hinged interconnection, adjacent the backrest, by means of shaft elements and bearing elements one of which is on the peripheral portions of the wheels and the other of which is on the frame, g. said backrest portion directly overlying and supported by said hinged interconnection and said one of said tie members in each of said frame positions, h. the frame and said rotary support having hinged interconnection, adjacent the backrest.

2. The apparatus of claim 1 wherein the frame defines a chaise lounge, there being a sling supported by and between rails integral with the frame.

* * * * *

UNITED STATES PATENT OFFICE

CERTIFICATE OF CORRECTION

PATENT NO. : 4,066,294

DATED : January 3, 1978

INVENTOR(S) : Heinz Meier

It is certified that error appears in the above-identified patent and that said Letters Patent are hereby corrected as shown below:

Column 4, line 60; "of said tie members in each of said frame positions," should read --of said tie members in each of said frame positions.--

Column 4, lines 61 and 62; delete "h. the frame and said rotary support having hinged interconnection, adjacent the backrest."

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*